US008471161B2

(12) United States Patent
Chou

(10) Patent No.: US 8,471,161 B2
(45) Date of Patent: Jun. 25, 2013

(54) ROLLING-BALL SWITCH

(76) Inventor: Tien-Ming Chou, Taichung (TW)

( * ) Notice: Subject to any disclaimer, the term of this patent is extended or adjusted under 35 U.S.C. 154(b) by 247 days.

(21) Appl. No.: 13/163,888

(22) Filed: Jun. 20, 2011

(65) Prior Publication Data

US 2012/0193195 A1 Aug. 2, 2012

(51) Int. Cl.
*H01H 35/14* (2006.01)

(52) U.S. Cl.
USPC ..... 200/277; 200/61.45 R

(58) Field of Classification Search
USPC ..... 200/277
See application file for complete search history.

(56) References Cited

U.S. PATENT DOCUMENTS

| | | | | |
|---|---|---|---|---|
| 7,465,893 | B2 * | 12/2008 | Chou | 200/61.45 R |
| 2010/0038360 | A1 * | 2/2010 | McDonnell | 220/4.28 |
| 2012/0267372 | A1 * | 10/2012 | Sadiq et al. | 220/303 |

FOREIGN PATENT DOCUMENTS

| | | |
|---|---|---|
| TW | I321798 B | 3/2010 |

* cited by examiner

*Primary Examiner* — Renee S Luebke
*Assistant Examiner* — Ahmed Saeed
(74) *Attorney, Agent, or Firm* — McNees Wallace & Nurick LLC

(57) ABSTRACT

A rolling-ball switch includes a surrounding wall defining an axial hole and including two opposite open ends, and two metallic terminals plugged in the axial hole respectively from the open ends. The surrounding wall has an inner surface formed with two spaced-apart first annular recesses proximate to the open ends, respectively, and two spaced-apart second annular recesses respectively adjacent to the first annular recesses but distal from the respective open ends. Each terminal has an insert portion inserted into the axial hole, and axially spaced-apart first and second barbed surfaces formed annularly around the insert portion. The first barbed surface is engaged to a respective first annular recess. The second barbed surfaces of the metallic terminals are engageable respectively with the second annular recesses when the terminals expand due to heat. A ball member is disposed rollably in the axial hole to contact the terminals.

5 Claims, 4 Drawing Sheets

ROLLING-BALL SWITCH

BACKGROUND OF THE INVENTION

1. Field of the Invention

The invention relates to a switch, and more particularly to a rolling-ball switch that can form a closed or open circuit through a rolling movement of a ball member.

2. Description of the Related Art

Referring to FIG. 1, a conventional roiling-ball switch 100, as disclosed by the applicant in Taiwanese Patent No. I321798, includes a plastic housing 11, two metallic terminals 12, and two ball members 13. The plastic housing 11 has a surrounding wall 111 defining an axial hole 110, and two first engaging portions 112 provided respectively on two opposite open ends of the surrounding wall 111. The terminals 12 close the respective open ends of the surrounding wall 111, and have second engaging portions 121 engaged respectively to the first engaging portions 112.

In normal use, the ball members 13 are in contact with each other and with the respective terminals 12 to place the rolling-bail switch 100 in an ON state. When an external force is applied to the switch 100, the ball members 13 are moved away from each other to shift the switch 100 to an OFF state.

However, because the metallic terminals 12 may expand due to heat, in the ON state, although the second engaging portions 121 of the terminals 12 may be engaged to the first engaging portions 112 of the surrounding wall 11, the terminals 12 are likely to push the two opposite ends of the surrounding wall 12 outward. As a result, the terminals 12 are likely to be released from and moved out of the housing 11. Hence, the structure of the conventional rolling-ball switch 100 is unstable.

SUMMARY OF THE INVENTION

Therefore, an object of the present invention is to provide a rolling-ball switch that has an enhanced and stable structure.

According to this invention, a rolling-ball switch comprises a housing, two metallic terminals, and at least one ball member. The housing has a surrounding wall that defines an axial hole and that includes two opposite open ends. The surrounding wall has an inner surface formed with two spaced-apart first annular recesses which are proximate to the open ends, respectively, and two spaced-apart second annular recesses which are respectively adjacent to the first annular recesses but which are distal from the respective open ends. Each second annular recess has a depth from the inner surface larger than that of the first annular recesses. The two metallic terminals are plugged in the axial hole respectively from the open ends. Each metallic terminal has an insert portion inserted into the axial hole, and axially spaced-apart first and second barbed surfaces formed annularly around the insert portion. The first barbed surface is engaged to a respective first annular recess. The second barbed surfaces of the metallic terminals are engageable respectively with the second annular recesses when the metallic terminals expand due to heat. The ball member is disposed rollably in the axial hole to contact the metallic terminals.

An advantage of the present invention resides in the fact that through the different depths of the first and second annular recesses, the terminals are permitted to remain engaged to the first or second annular recesses when the terminals expand or retract, thereby enhancing the stability of the switch of the present invention.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
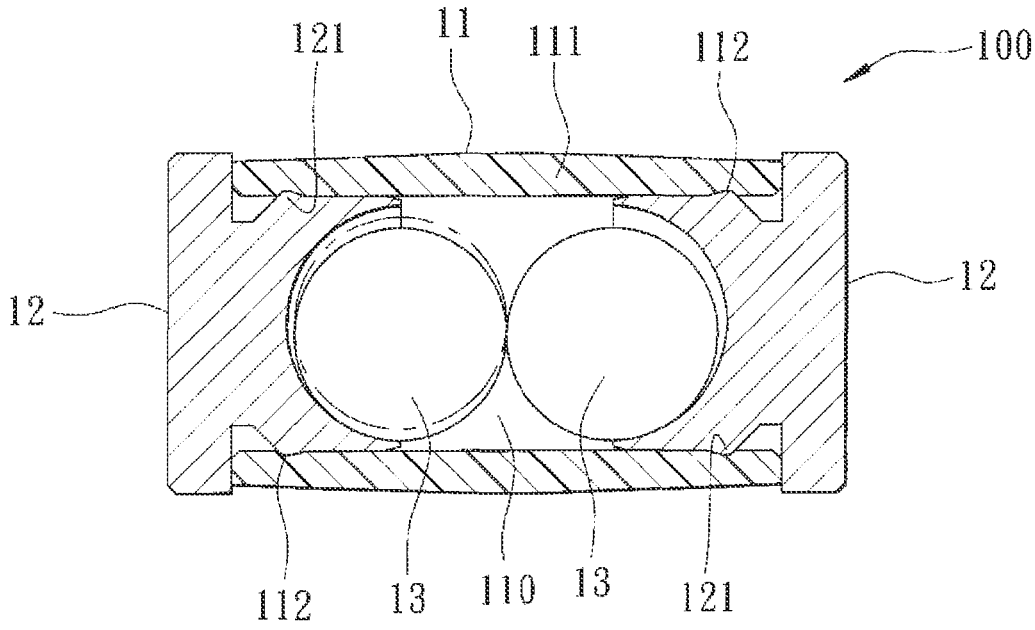
FIG. 1 PRIOR ART
FIG. 1 is a sectional view of a conventional rolling-ball switch as disclosed by the applicant in Taiwanese Patent No. I321798.
Figure 2:
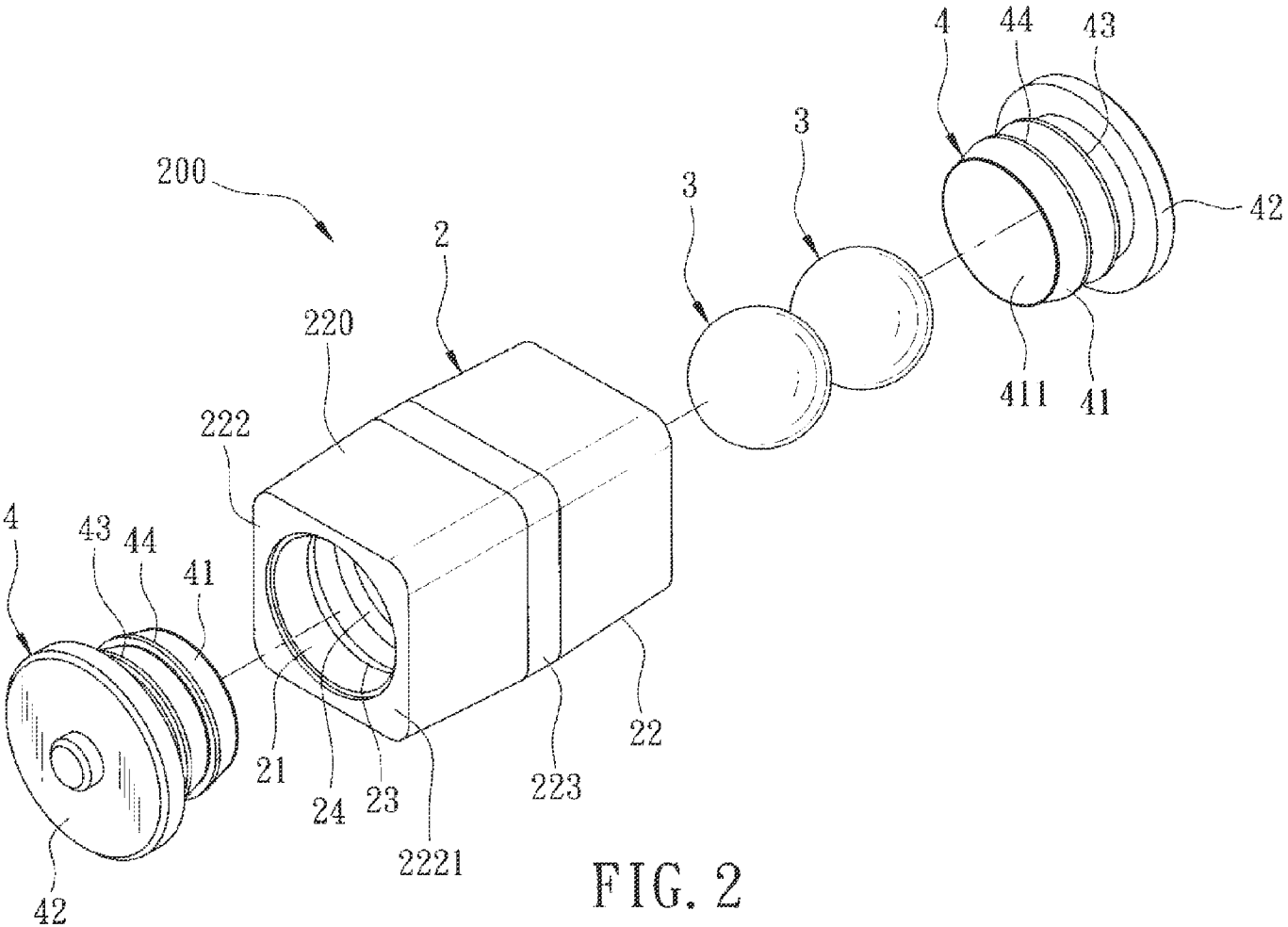
FIG. 2 is an exploded perspective view of a rolling-ball switch according to the preferred embodiment of the present invention.
Figure 3:
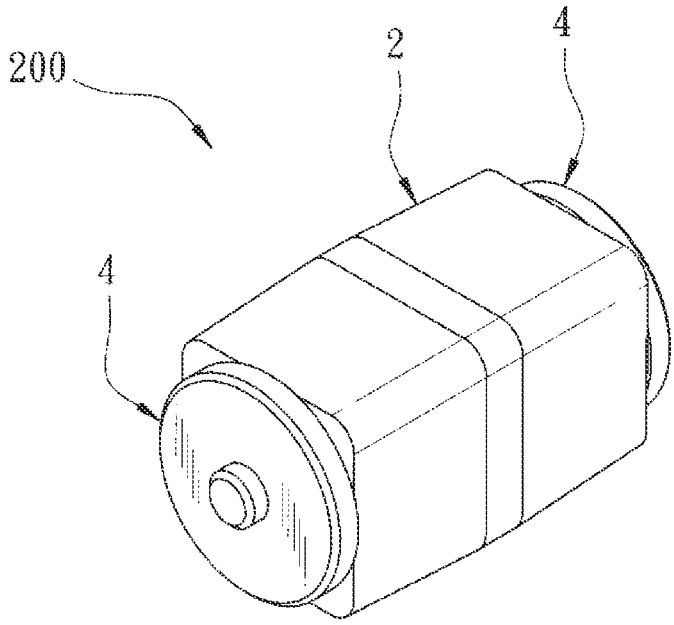
FIG. 3 is a perspective view of the preferred embodiment in an assembled state.
Figure 4:
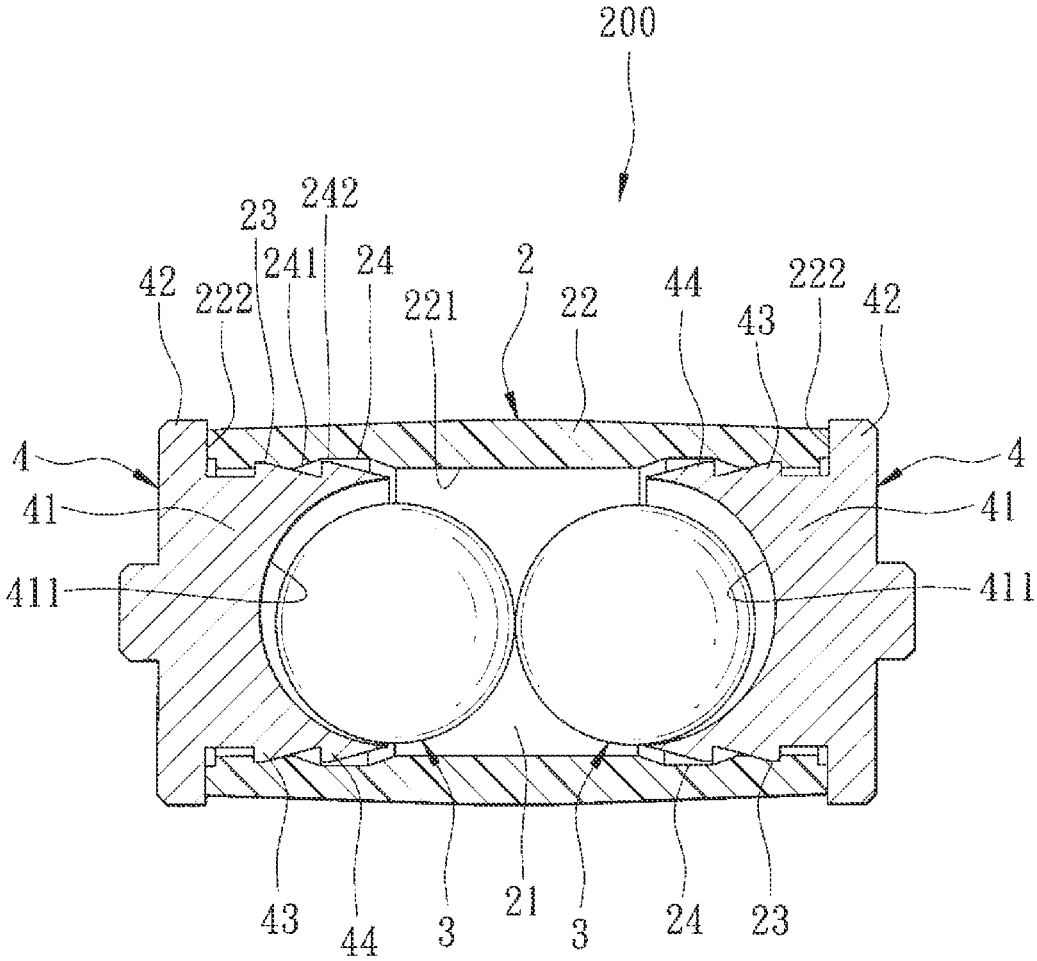
FIG. 4 is an assembled sectional view of the preferred embodiment.

Referring to FIGS. 2, 3, and 4, a rolling-ball switch 200 according to the preferred embodiment of the present invention is shown to comprise a housing 2, two ball members 3, and two metallic terminals 4.

The housing 2 is made of plastic, and has a surrounding wall 22 defining an axial hole 21. The surrounding wall 22 includes two opposite open ends 222 each having an end face 2221, two spaced-apart first annular recesses 23 formed in an inner surface 221 of the surrounding wall 22 and proximate to the open ends 222, respectively, and two spaced-apart second annular recesses 24 respectively adjacent to the first annular recesses but distal from the respective open ends 222. The surrounding wall 22 has an outer peripheral surface 220 that tapers from a midpart 223 toward the open ends 222. Each second annular recess 24 is defined by two spaced-apart inclined surfaces 241 that indent gradually from the inner surface 221, and a deepened surface 242 interconnecting the inclined surfaces 221. Thus, each second annular recess 24 has a depth from the inner surface 221 larger than that of the first annular recess 23.

The ball members 3 are disposed rollably in the axial hole 21 of the housing 2.

The metallic terminals 4 are plugged in the axial hole 21 respectively from the open ends 222 of the surrounding wall 22. Each terminal 4 has an insert portion 41 inserted into the axial hole 21, axially spaced-apart first and second barbed surfaces 43, 44 formed annularly around the insert portion 41, and an annular end flange 42 extending radially from the insert portion 41 and abutting against the end face 2221 of the respective open end 222. The insert portion 41 of each terminal 4 has a concave face 411 formed on an end face thereof. The concave faces 411 of the insert portions 41 of the terminals 4 face each other.

To assemble the switch 200, the ball members 3 are first placed in the axial hole 21 of the housing 2, after which the insert portions 41 of the terminals 4 are press-fitted into the axial hole 21 until the end flanges 42 of the terminals 4 abut against the end faces 2221 of the respective open ends 222 of the surrounding wall 22. At this time, the first and second barbed surfaces 43, 44 of each terminal 4 are engaged respectively to the first and the second annular recesses 23, 24. Through this configuration, the terminals 4 can be fixed stably to the housing 2, and the ball members 3 can be limited to roll within the axial hole 21.

In a normal state, even though the second barbed surface 44 of each terminal 4 is not stably engaged to the respective second annular recess 24 because of its larger depth, each terminal 4 at this time can only make use of the engagement between the first barbed surface 43 and the respectively first annular recess 43 to position each terminal 4 on the housing 2. When the terminals 4 expand and deform due to heat, although the first barbed surface 43 of each terminal 4 may be released from and moved out of engagement with the respective first annular recess 23, the second barbed surface 44 of each terminal 4 at this time may expand and engage the respective second annular recess 24, thereby stably fixing each terminal 4 to the housing 2.

Because the outer peripheral surface 220 of the surrounding wall 22 tapers from the midpart 223 toward the open ends 222, an indentation can be formed around the outer peripheral surface 220 between the annular end flange 42 of each terminal 4 and the midpart 223 to fill a soldering material. In normal use, the ball members 3 will contact each other and the respective concave faces 411 of the terminals 4 so that the terminals 4 form a closed circuit, thereby placing the switch 200 in an "ON" state. When an external force is applied to the switch 200, one of the ball members 3 is either moved away from the other ball member 3 while remaining in contact with the respective concave face 411, or moved away from the respective concave face 411 while remaining in contact with the other ball member 3, so that the terminals 4 form an open circuit, thereby shifting the switch 200 from the "ON" state to an "OFF" state.

Through the aforesaid description, the advantage of the present invention resides in the fact that through the different depths of the first and second annular recesses 23, 24, when the terminals 4 expand or retract, the terminals 4 can remain engaged to the first or second annular recesses 23, 24, thereby enhancing the stability of the switch 200 of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A rolling-ball switch comprising:

a housing having a surrounding wall that defines an axial hole and that includes two opposite open ends, said surrounding wall having an inner surface formed with two spaced-apart first annular recesses which are proximate to said open ends, respectively, and two spaced-apart second annular recesses which are respectively adjacent to said first annular recesses but which are distal from said respective open ends, each of said second annular recesses having a depth from said inner surface larger than that of said first annular recesses;

two metallic terminals plugged in said axial hole respectively from said open ends, each of said metallic terminals having an insert portion inserted into said axial hole, and axially spaced-apart first and second barbed surfaces formed annularly around said insert portion, said first barbed surface being engaged to a respective one of said first annular recesses, said second barbed surfaces of said metallic terminals being engageable respectively with said second annular recesses when said metallic terminals expand due to heat; and at least one ball member disposed rollably in said axial hole to contact said metallic terminals.

2. The rolling-ball switch of claim 1, wherein each of said second annular recesses is defined by two spaced-apart inclined surfaces that indent gradually from said inner surface of said surrounding wall, and a deepened surface interconnecting said inclined surfaces.

3. The rolling-ball switch of claim 1, wherein said surrounding wall further has an outer peripheral surface that tapers from a midpart of said outer peripheral surface toward said open ends.

4. The rolling-ball switch of claim 1, wherein each of said metallic terminals further has an annular end flange extending radially from said insert portion and abutting against an end face of the respective one of said open ends.

5. The rolling-ball switch of claim 1, wherein said rolling-ball switch includes two said ball members respectively and constantly contacting said metallic terminals, said ball members being movable toward or away from each other.

* * * * *